US006851880B2

(12) United States Patent
Suzuki

(10) Patent No.: US 6,851,880 B2
(45) Date of Patent: Feb. 8, 2005

(54) COATING TOOL AND COATING SET

(75) Inventor: Yoshiaki Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/230,108

(22) Filed: Aug. 29, 2002

(65) Prior Publication Data

US 2003/0070614 A1 Apr. 17, 2003

(30) Foreign Application Priority Data

Sep. 4, 2001 (JP) ..... 2001-267310

(51) Int. Cl.[7] ..... B05C 17/00

(52) U.S. Cl. ..... 401/6; 118/268; 118/269; 369/72; 369/275.5; 401/126; 401/127; 401/130; 401/195; 401/196; 401/207; 401/261; 427/429

(58) Field of Search ..... 401/6, 119, 130, 401/127, 126, 191, 207, 196, 261, 195; 369/72, 275.5; 427/429; 118/264, 268, 269

(56) References Cited

U.S. PATENT DOCUMENTS

| | | | | |
|---|---|---|---|---|
| 4,202,870 A | | 5/1980 | Weber et al. | 423/630 |
| 4,242,271 A | | 12/1980 | Weber et al. | 260/448 |
| 5,091,009 A | | 2/1992 | Nogami et al. | 106/287.1 |
| 5,221,497 A | | 6/1993 | Watanabe et al. | 252/313.2 |
| 5,868,839 A | * | 2/1999 | Kato et al. | 118/264 |
| 2003/0054113 A1 | * | 3/2003 | Suzuki et al. | 427/429 |
| 2003/0068188 A1 | | 4/2003 | Suzuki et al. | 401/130 |

FOREIGN PATENT DOCUMENTS

| | | |
|---|---|---|
| JP | 57-44605 | 3/1982 |
| JP | 2881847 B2 | 12/1989 |
| JP | 2803134 B2 | 10/1990 |

* cited by examiner

*Primary Examiner*—Gregory L. Huson
*Assistant Examiner*—Kathleen J. Prunner
(74) *Attorney, Agent, or Firm*—Fitzpatrick, Cella, Harper & Scinto

(57) ABSTRACT

A coating tool and a coating set including such a coating tool can uniformly and reliably apply protection liquid onto the recording surface of a recording medium so as to avoid problems of uneven application and uncoated areas. The coating tool comprises a protection liquid absorbing member for absorbing and holding protection liquid. The protection liquid absorbing member is formed to show a density not less than 30 kg/m$^3$.

15 Claims, 12 Drawing Sheets

COATING TOOL AND COATING SET

BACKGROUND OF THE INVENTION

1. Field of the Invention

This invention relates to a coating tool to be used for applying protection liquid for protecting information such as images on the recording surface of a recording medium recorded typically by means of an ink-jet recording system and also to a coating set including such a coating tool.

2. Related Background Art

As a result of the technological developments for forming images with an increased number of gradations by using smaller recording liquid droplets in recent years, ink-jet recording apparatus have been made to be capable of recording not only texts of characters but also pictures that are comparable to photographs in terms of tone on a recording medium such as a sheet of paper. At the same time, due to the widespread use of digital cameras, it has been made possible to output and record not only texts and designed images but also photograph-like pictures and graphic arts with the level of image quality comparable to that of images displayed on the display screen. Under these circumstances, ink-jet recording apparatus are further expanding their applicable field. Then, by turn, the images recorded on recording mediums are required to be conservable and durable without changing the image quality with time. In other words, they are required to show a long service life.

Recorded images show an excellent coloring effect if they are recorded on an appropriate recording medium typically by using dye-type inks but may be less durable and conservable. To the contrary, images recorded by using pigment-type inks are highly conservable but may not be satisfactory in terms of coloring effect and scratch-resistance.

Therefore, from the viewpoint of conserving recorded images for a long period of time, measures have to be taken for improving the durability of images recorded by using pigment-type inks. Similarly, measures have to be taken for developing methods of protecting dye-type coloring materials that are poorly durable. Known methods of protecting recorded images include the use of film-forming resin such as acryl type resin for protection film that is typically produced by lamination of resin on the recorded image.

SUMMARY OF THE INVENTION

However, known methods of protecting recorded images by covering the image formed on the recording surface of a recording medium with glass or by laminating the recorded image with resin film are feasible only at the cost of sacrificing the texture of the recorded image. In other words, the viewers of the recorded image are forced to see the image only by way of film or glass. They cannot directly see the image.

Protection methods of applying non-volatile protection liquid to a recorded image for the purpose of protecting the image have been proposed so that the viewers of the recorded image may be able to see the image without a protection layer of glass or film and enjoy the texture of the image.

However, the method of applying protection liquid has a drawback that it is highly difficult to uniformly apply protection liquid onto the recording surface of a recording medium particularly when the protection liquid is highly viscous. Then, the outcome of application of protection liquid onto the recording medium including the rate at which the liquid is applied can vary remarkably depending on the liquid application operator and problems of uneven application and uncoated areas can arise.

Therefore, it is the object of the present invention to provide a coating tool and a coating set including such a coating tool that can uniformly and reliably apply protection liquid onto the recording surface of a recording medium so as to avoid problems of uneven application and uncoated areas.

According to the invention, the above object is achieved by providing a coating tool for applying protection liquid onto the surface of a recorded matter recorded on a recording medium by injecting ink by means of an ink-jet recording system, the tool comprising a protection liquid absorbing member for absorbing and holding protection liquid, the protection liquid absorbing member having a coating surface to be pressed against the recording surface; a holding member having a holding section holding the protection liquid absorbing member; and a grip section to be gripped for holding the holding section, wherein the protection liquid absorbing member has a density of at least 30 kg/M$^3$.

In another aspect of the invention, there is provided a coating set comprising a coating tool according to the invention and a container having a storage section storing protection liquid.

The protection liquid is applied uniformly on the recording surface of a recording medium regardless of variance in the coating operation of the operator of a coating tool when it is applied by means of the holding member of the coating tool according to the invention holding the protection liquid absorbing member that is formed to show a density not less than 30 kg/m$^3$.

Preferably, the holding section of the holding member has holding pawls for holding the protection liquid absorbing member. With the provision of holding pawls, it is no longer necessary to bond the protection liquid absorbing member to the holding member by means of adhesive. Then, the risk that some of the ingredients of the adhesive leak out into protection liquid and the adhesive are degraded by protection liquid is prevented from occurring.

Preferably, the protection liquid absorbing member is supported as the entire rear surface of the protection liquid absorbing member disposed opposite to the coating surface thereof is made to abut the holding section of the holding member. Preferably, the holding section of the holding member is provided with a plurality of support ribs adapted to abut and support the rear surface of the protection liquid absorbing member. With this arrangement, the entire coating surface of the protection liquid absorbing member is made to slide smoothly on the recording medium when applying protection liquid onto the recording medium.

Preferably, the coating surface of the protection liquid absorbing member is deflected to a predetermined extent with a curved recess formed in a substantially central part thereof so as to make the coating surface become a flat surface in a condition where a predetermined load is applied to it for the operation of applying protection liquid. With this arrangement, the entire coating surface of the protection liquid absorbing member is made to slide smoothly on the recording medium when applying protection liquid onto the recording medium.

Preferably, the holding member is provided with a plurality of ventilation ports for leading air to the protection liquid absorbing member at positions of the holding section corresponding to the lateral surfaces or the rear surface of the protection liquid absorbing member. With the provision of such ventilation ports, the operation of causing the protection liquid absorbing member to absorb and discharge protection liquid can be performed well.

The present invention is achieved as a result of intensive research efforts for allowing an image formed on the recording surface of a recording medium to be directly viewed and maintain a long service life without using a transparent layer, only through which the image can be viewed at the cost of sacrificing the texture of the recorded image.

The present invention specifically aims to remove sites where reactions can take place to degrade the coloring materials of the image formed on a recording medium by filling the voids left in the ink receiving layer of the recording medium after recording the image by means of a coloring system adapted to make the coloring materials adhering to the ink receiving layer clearly produce colors. If lowly viscous protection liquid is used, it can quickly penetrate into the ink receiving layer so that it can be applied with ease. However, protection liquid is required to show an appropriately high degree of viscosity in order to have it retained in the ink receiving layer. When a highly viscous protection liquid is used, the use of a coating tool that can uniformly apply protection liquid is very important. Thus, the objective of the present invention is to provide a means for applying relatively highly viscous protection liquid onto a recording surface (carrying an image) uniformly at a predetermined rate without producing flaws.

For the purpose of the present invention, preferably, the following problems have to be dissolved when protecting an image by using protection liquid.

(1) Recording mediums to which protection liquid is applied may have a number of different sizes including:

photograph size, which is also referred to as the L size (89 mm×119 mm), post card size (100 mm×148 mm), 2L size (twice as large as the L size) (119 mm×178 mm), A4 size (210 mm×297 mm), and A3 size (420 mm×297 mm).

Therefore, it is highly desirable that protection liquid is applied to the recording surfaces of recording mediums of different sizes at an appropriate rate.

(2) The recording medium carrying an image needs to be rigidly secured when applying protection liquid onto the image. If the recording medium is held by hand at some of the corners thereof, it is not possible to apply protection liquid to the areas held by hand. If protection liquid is applied to the uncoated areas after coating the other area, it will be difficult to firmly hold the recording medium because the recording medium is very slippery. Additionally, the operator of a coating tool may have an unpleasant feeling if protection liquid sticks to the hand during the coating operation.

As a result of intensive research efforts paid to dissolve the above problems and other problems particularly from the viewpoint of technical elements and materials, the inventors of the present invention invented a coating tool and a coating set.

A coating tool according to the invention is adapted to uniformly apply non-volatile protection liquid that does not dissolve the coloring materials of the image formed on a recording medium that comprises a base member and a porous ink receiving layer formed on the surface of the base member, where the image is formed by the coloring materials adsorbed at least to the porous layer.

DESCRIPTION OF THE PREFERRED EMBODIMENTS

Figure 1:
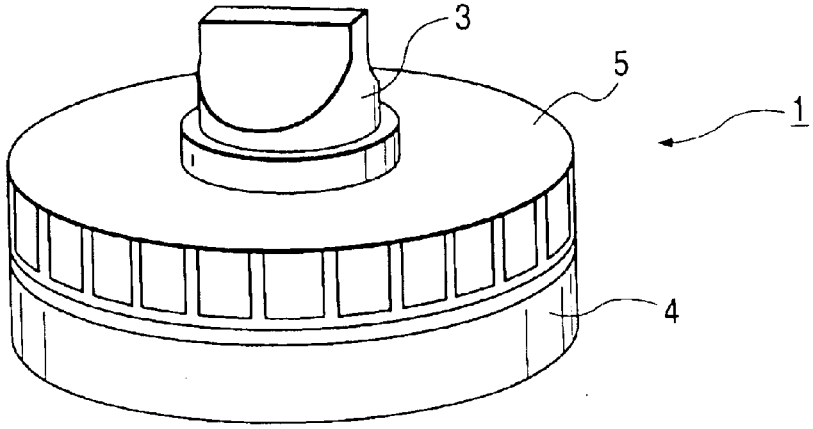
FIG. 1 is a schematic perspective view of a coating set according to the invention.

Now, the present invention will be described by referring to the accompanying drawings that illustrate preferred embodiments of coating set according to the invention for applying protection liquid to a recording medium.

Firstly, some of the technical aspects of recording mediums to which protection liquid is applied by means of a coating set according to the invention, protection liquid to be applied to such recording mediums and a coating set to be used for applying protection liquid will be discussed.

Recording mediums to which protection liquid is applied by means of a coating set according to the invention for the purpose of protecting the image formed on the recording medium typically include sheets of paper. Such a sheet of paper has a porous layer that operates as ink receiving layer and an image is formed on it as ink containing one or more than one coloring materials is applied to it. For protecting the image formed on a sheet of paper by applying protection liquid, the sheet of paper is impregnated with liquid such as silicone oil or aliphatic acid ester. Therefore, the recording medium is desirably such that liquid would not flow through it and the image is recorded on it as the applied coloring materials such as pigments and/or dyes are adsorbed to some of the micro-particles that constitute the porous structure of the ink receiving layer formed on the base member. Recording mediums having such characteristic features may advantageously be used particularly when an ink-jet recording system is employed for recording images. Furthermore, it is preferable that recording mediums to be used with an ink-jet recording system for recording images are of the so-called absorption type that is adapted to absorb ink by way of the voids formed in the ink receiving layer laid on the base member. The ink receiving layer of the absorption type recording medium comprises micro-particles as principal component thereof and may be realized as a porous layer containing additives such as a binding agent and/or other one or more than one additives. Micro-particles that can be used for recording mediums of the absorption type include those of silica, clay, talc, calcium carbonate, kaolin, aluminum oxide such as alumina and alumina hydrate, diatomaceous earth, titanium oxide, hydrotalcite, inorganic pigments such as zinc oxide and organic pigments such as urea formalin resin, ethylenic resins and styrenic resins. One or more than one of such substances may be used for the ink receiving layer. Binding agents that can suitably be used for the ink receiving layer include water-soluble polymers and latex. Examples of such binding agents include polyvinyl alcohol and modified products thereof, starch and modified products thereof, gelatin and modified products thereof, gum arabic, cellulose derivatives such as carboxymethylcellulose, hydroxyethylcellulose and hydroxypropylmethylcellulose, SBR (styrene-butadiene rubber) latex, NBR (nitrile-butadiene rubber) latex, methylmethacrylate-butadiene copolymer latex, functional group modified polymer latex, vinylic copolymer latex such as ethylene-vinylacetate copolymer, polyvinylpyrrolidone, maleic anhydride and copolymers thereof and acrylic ester copolymers. If necessary, two or more than two of them may be combined for use. Other additives that can be used for the ink receiving layer include dispersants, thickening agents, pH regulators, lubricants, fluidity modifiers, surfactants, defoamers, mold-release agents, fluorescent brighteners, UV absorbents and anti-oxidants.

Recording mediums that can particularly advantageously be used for the purpose of the invention include those having an ink receiving layer formed by mainly using micro-particles having an average particle diameter of not greater than 10 $\mu$m, preferably not greater than 1 $\mu$m. Particularly preferable materials for preparing such micro-particles typically include silica and aluminum oxide. Micro-particles of aluminum oxide and silica are particularly preferable probably for the reason as described below. It has been found that the coloring materials adsorbed to micro-particles of aluminum oxide and silica remarkably lose their colors and their colors become faded due to gases such as $NO_x$, $SO_x$ and ozone. On the other hand, such micro-particles are apt to attract such gases and hence it is likely that such gases are found in the vicinity of the coloring materials applied to the ink receiving layer to by turn fade the colors of the coloring materials. Colloidal silica is a particularly advantageous form of micro-particles of silica. While colloidal silica is commercially available, the use of colloidal silica as disclosed in Japanese Patent No. 2803134 or Japanese Patent No. 2881847 is particularly preferable. Micro-particles of alumina hydrate may particularly preferably be used as those of aluminum oxide. Alumina hydrate expressed by the chemical formula below is preferably used as alumina based pigment:

$$Al_2O_{3-n}(OH)_{2n}.mH_2O \quad (1),$$

Where n represents an integer that is equal to 1, 2 or 3 and m represents a numerical value between 0 and 10, preferably between 0 and 5, although m and n are not equal to 0 at the same time. Since $mH_2O$ also represents in many occasions a desorptable aqueous phase that does not participate in the formation of crystal lattice, m can be an integer or a numerical value other than an integer. When the substance is heated, the value of m can become equal to 0. Preferably, alumina hydrate is prepared by way of an appropriate known process such as hydrolysis of aluminum alkoxide as described in U.S. Pat. No. 4,242,271 or U.S. Pat. No. 4,202,870, hydrolysis of sodium aluminate, or neutralization of aqueous solution of sodium aluminate conducted by adding, aqueous solution of sodium sulfate or aluminum chloride thereto as described in Japanese Patent Publication No. 57-44605.

A recording medium that is prepared by using alumina hydrate as described above can most suitably be used when protection liquid is applied thereto by means of a coating tool according to the invention because the recording medium is excellent in terms of affinity for, absorption of and fixation of protection liquid and shows characteristic features required for realizing an image quality comparable to that of photographs such as transparency, gloss and fixation of the coloring materials in the recording liquid including dyes. The mixing ratio of the micro-particles to the binder in the recording medium is preferably between 1:1 and 100:1 by weight. The recording medium provides an optimal volume of pores for the ink receiving layer to be impregnated with protection liquid when the binder is added to the above defined ratio. The ink receiving layer preferably contains micro-particles of aluminum oxide or silica by not less than 50 wt %, more preferably by not less than 70 wt %, most preferably by not less than 80 wt % and not more than 99 wt %. The ink receiving layer is preferably formed at a rate not less than 10 g/m$^2$, more preferably between 10 and 30 g/m$^2$, as reduced to dry solid in order to allow the ink receiving layer to be impregnated with chemical agents for improving the effect of firmly maintaining the recorded image to a satisfactory extent.

Any material can be used without limitation for the base member so long as an ink receiving layer containing micro-particles can be formed on the base member in a manner as described above and the base member shows a level of rigidity that makes it possible to be transferred by the transfer mechanism of an ink-jet printer. Paper subjected to an appropriate sizing process at least at the side where an ink receiving layer is to be formed may suitably be used for the base member. Paper having a dense and porous layer (so-called baryta layer) formed by applying an inorganic pigment such as barium sulfate to a fibrous base member with a binding agent (e.g., baryta paper) may also suitably be used as base member. If a recording medium prepared by using such a base member and treated for improving the effect of firmly maintaining the recorded image is left for a long period of time in a high temperature and high humidity environment, problems such as the one that the chemical agents used for improving the effect of firmly maintaining the recorded image seep out to the surface of the recording medium to make the surface sticky can be effectively suppressed. Therefore, the use of such a recording medium is highly advantageous from the storage point of view. Note that recording mediums having a porous surface layer are not limited to those having a porous ink receiving layer formed on a base member and anodized aluminum may also be used for recording mediums.

Protection liquid that is used for the purpose of the present invention is preferably such that it does not dissolve the coloring materials applied to the porous layer of the recording medium nor affect the fixed image and that it is non-volatile and the coloring materials are protected to improve the durability of the image as the voids in the porous layer are filled by the applied protection liquid. Additionally, protection liquid is preferably such that it is transparent and of a general purpose type and does not affect the color tone of the recorded image but improves the quality of the image when the voids of the porous layer are filled with it, although it may be colored in some cases. While protection liquid is more often than not of a general purpose type when it is odorless, perfume may be added to it to make it emit a specific aroma suited to the image without adversely affecting the latter.

For the purpose of the present invention, protection liquid can be prepared by using at least an organic non-volatile oil selected from aliphatic esters, silicone oil, modified silicone and fluorine-containing oils.

It is preferable that protection liquid is absorbed and retained by the protection liquid absorbing member to a large extent and, at the same time, can appropriately penetrate into the porous layer where the coloring materials of the recording medium are fixed. Preferably, it shows a level of viscosity between 10 and 600 Cst (centistokes). The applied protection liquid will be retained reliably by the recording medium when its viscosity is not lower than 20 Cst. Additionally, protection liquid that shows a viscosity level not higher than 300 Cst can be applied uniformly to a recording medium with ease. Therefore, protection liquid showing a viscosity level between 20 and 300 Cst is particularly preferable from the viewpoint of retention and ease of application. By using protection liquid showing such a viscosity level, small variances in the rate of application can be effectively eliminated to level off the applied liquid, utilizing the fluidity of liquid that tends to spread, when protection liquid is supplied horizontally from thickly applied areas to unapplied areas, provided that each unapplied area is separated from an adjacent applied area by about 1 mm.

When applying protection liquid to the porous layer of a recording medium where the coloring materials are fixed, it is supplied at a rate exceeding the rate necessary for filling the voids in the porous layer where the coloring materials are fixed. Additionally, it is preferable that the surplus protection liquid remaining on the surface of the porous layer is removed from the surface in order to prevent a protection liquid layer comprising only protection liquid is formed on the surface of the porous layer when the voids in the porous layer are sufficiently filled with protection liquid.

FIGS. 15A, 15B, 15C and 15D are schematic cross sectional views of part of a recording medium, illustrating the distributions of protection liquid applied to the surface of the recording medium at different application rates. Referring to FIGS. 15A through 15D, the recording medium comprises a base member 11, a reflection layer 12 and an ink receiving layer 13 to produce a multilayer structure. FIGS. 15A, 15B, 15C and 15D respectively show situations where the rate of application of protection liquid is "too low", "appropriate", "slightly excessive" and "highly excessive".

Figure 15A:
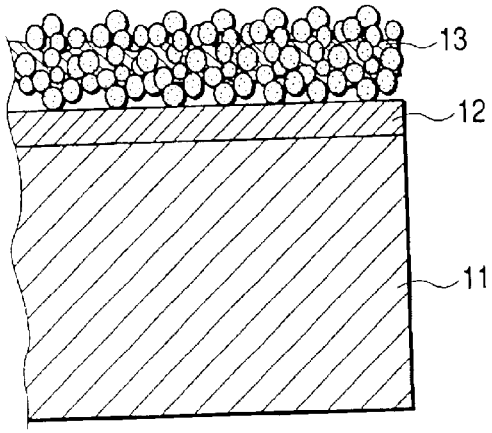
FIGS. 15A, 15B, 15C and 15D are schematic cross sectional views of part of a recording medium, illustrating the distributions of protection liquid applied to the surface of the recording medium at different application rates.
Figure 15B:
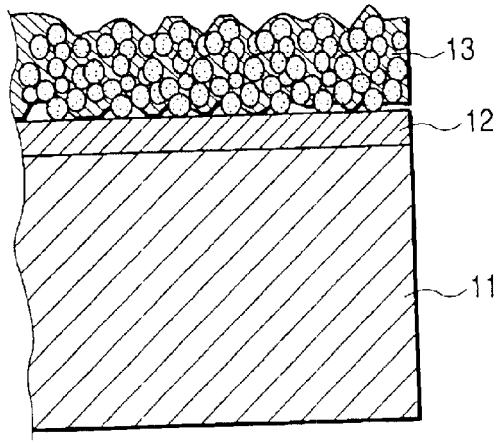
Figure 15C:
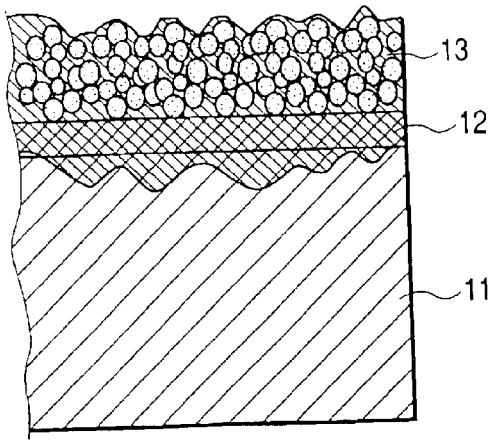
Figure 15D:
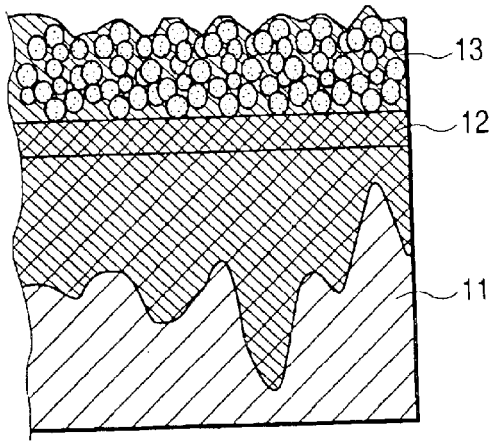

When the rate of application of protection liquid is too low as shown in FIG. 15A, the optical density (OD) is reduced by random reflection while the durability of the recorded image is not improved and the areas penetrated by protection liquid can become uneven as time elapses to a great disadvantage of the recorded image. When the rate of application of protection liquid is appropriate as shown in FIG. 15B and when it is slightly excessive as shown in FIG. 15C, the voids in the porous layer are filled by protection liquid and protection liquid gets to the surface of the base member to wet the latter or the surface and its vicinity of the base member are slightly penetrated by protection liquid. Then, the optical density is raised to make the image appear neat and clear and the durability of the recorded image is improved. Finally, when the rate of application of protection liquid is highly excessive as shown in FIG. 15D, the optical density and the durability of the recorded image are improved but stains can appear particularly if the image is dominantly white. Therefore, it is advisable to avoid a highly excessive rate of application of protection liquid when treating an image having a large white area.

When a base member having a surface adapted to absorb protection liquid is used in a manner as described above, it is particularly preferable in the final stage of application of protection liquid that only the ink receiving layer or the ink receiving layer and part of the base member are filled with protection liquid, which is oil, over the entire surface of the recording medium as shown in FIG. 15B and FIG. 15C respectively.

When protection liquid is applied by means of a block-shaped protection liquid absorbing member that is being grasped by hand, it is appropriate that the surface of the protection liquid absorbing member to be used for applying protection liquid has a size between 1 cm×1 cm and 20 cm×20 cm. Thus, the surface area of the protection liquid absorbing member having such an appropriate size is between 1 and 400 $cm^2$.

Then, the surface of the protection liquid absorbing member to be used for applying protection liquid is required to have an area of a certain magnitude so that protection liquid may be applied uniformly onto the recording surface of the recording medium. For example, the size required for that purpose may need to be at least 3 cm×3 cm or 2 cm×5 cm. On the other hand, from the viewpoint of ease of use and ease of grasping, the size may need to be 10 cm×10 cm. Then, the surface area of the protection liquid absorbing member having such a size is between 10 $cm^2$ and 100 $cm^2$. A protection liquid absorbing member having such a surface area provides ease of use and ease of grasping.

Additionally, the operator of a coating tool may have an unpleasant feeling if protection liquid sticks to the hand during the coating operation. Then, the coating may be provided with a grip section such as a handle at the holding member holding the protection liquid absorbing member so that the operator may apply protection liquid by way of the holding member. If such is the case and the action of holding the grip section and applying protection liquid is considered, the area of the surface of the protection liquid absorbing member to be used for applying protection liquid needs to be made smaller, typically between 10 $cm^2$ and 50 $cm^2$.

Taking the above listed factors into consideration, the surface to be used for applying protection liquid of the protection liquid absorbing member of a coating tool according to the invention is between 10 $cm^2$ and 50 $cm^2$ if the protection liquid absorbing member is used by way of a holding member. Then, the operator of a coating tool will not have any unpleasant feeling which is caused if protection liquid sticks to the hand during the coating operation. Additionally, the operator is not required to have any particular skill for the liquid applying operation so that any unskilled operators can easily and reliably perform a protection liquid applying operation regardless of variances in the protection liquid application technique among the operators.

Figure 2:
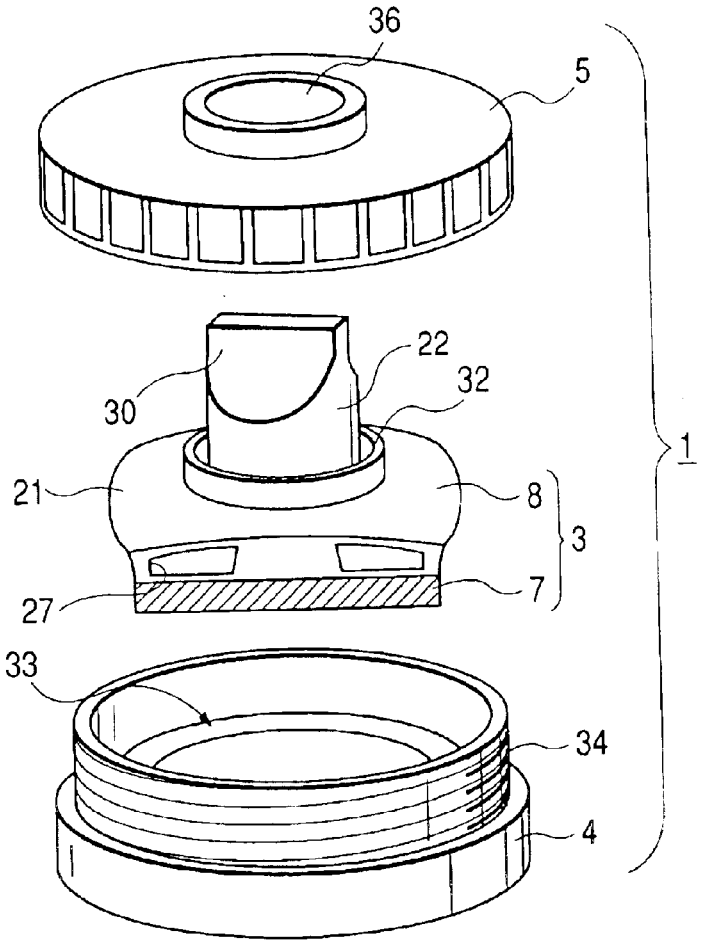
FIG. 2 is an exploded schematic perspective view of the coating set of FIG. 1.

As shown in FIGS. 1 and 2, this embodiment of coating set 1 comprises a coating tool 3 to be used for applying protection liquid, a container 4 for containing protection liquid to be applied by the coating tool 3 and a closure member 5 adapted to airtightly close the container 4.

The coating tool 3 by turn comprises a protection liquid absorbing member 7 and a holding member 8 holding the protection liquid absorbing member 7.

The protection liquid absorbing member 7 of the coating tool 3 is adapted to absorb protection liquid by an amount much greater than the amount to be applied onto the recording surface of a recording medium. As protection liquid is supplied from the protection liquid absorbing member 7 at a controlled rate, the entire image recorded on the recording medium is uniformly coated with protection liquid. More specifically, the protection liquid absorbing member 7 can absorb protection liquid by an amount three to ten times greater than the amount necessary for coating the image on the recording medium so that an amount greater than the amount necessary for coating the image is supplied from the protection liquid absorbing member 7 at a substantially constant rate suited for uniformly coating the image. The protection liquid absorbing member 7 is typically made of a foamed material such as polyester type polyurethane foam or polyether type polyurethane foam, a porous material such as urethane sponge, polypropylene fiber or melamine resin.

Figure 3:
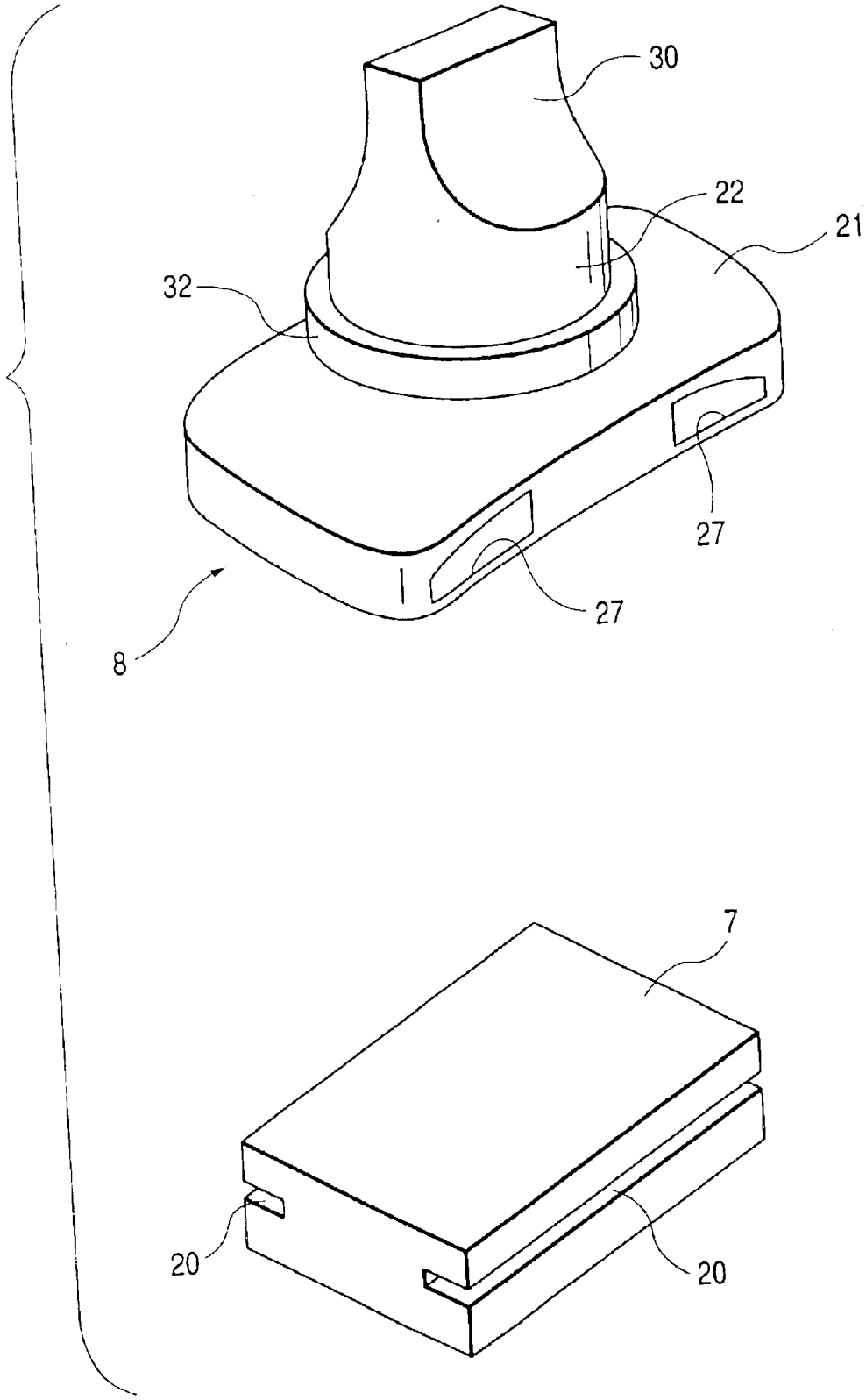
FIG. 3 is an exploded schematic perspective view of the coating set of FIG. 1, illustrating the coating tool thereof.
Figure 4:
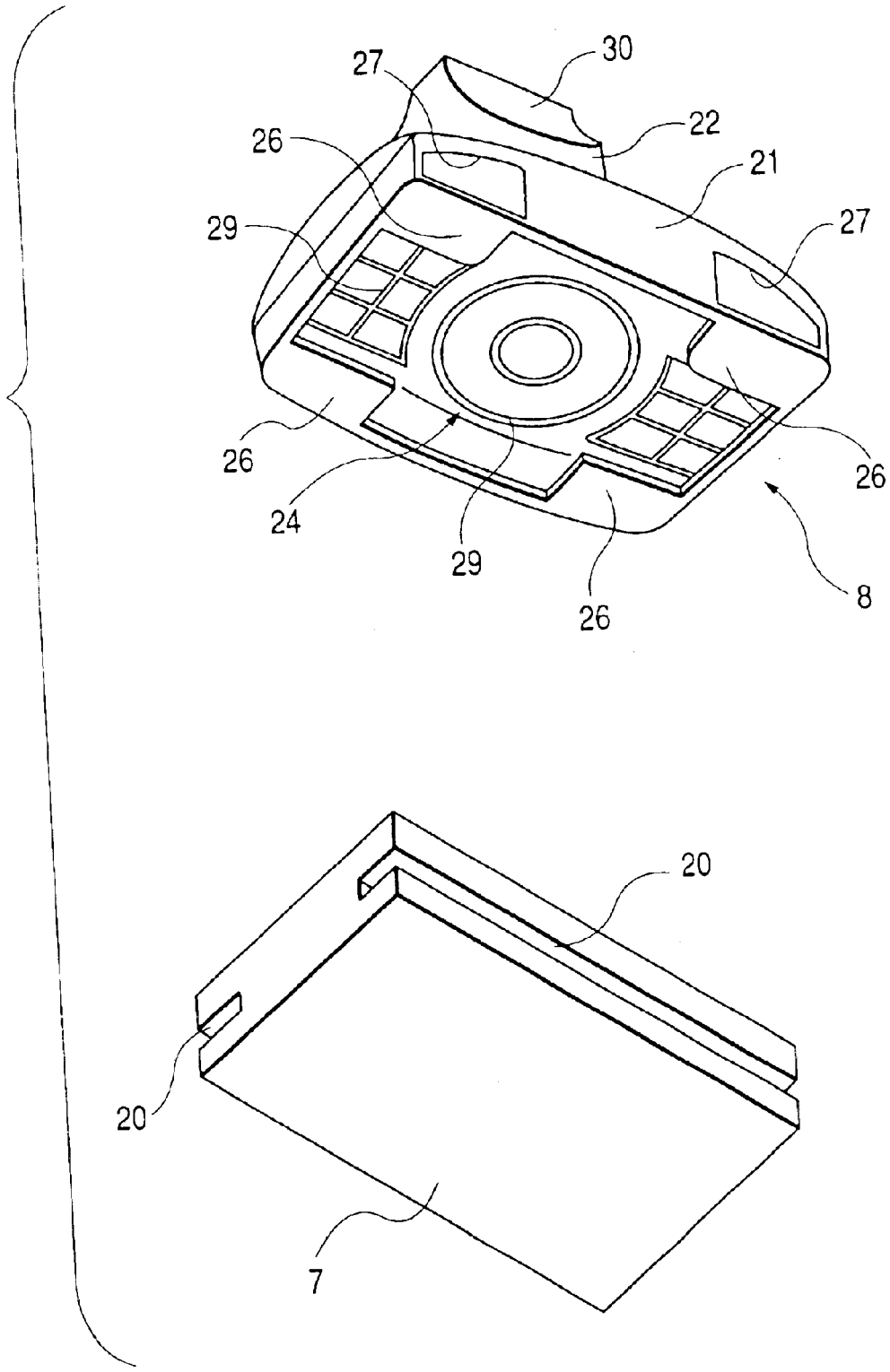
FIG. 4 is an exploded schematic perspective view of the coating tool of FIG. 3, as viewed from the protection liquid absorbing member side.

Preferably, the protection liquid absorbing member 7 has a density at least 30 kg/m3 or more. More specifically, it preferably shows a density between 30 kg/m3 and 200 kg/m3. The protection liquid absorbing member 7 is provided at opposite lateral surfaces thereof with respective notched longitudinal grooves 20 that are used when the protection liquid absorbing member 7 is held by the holding member 8 as shown in FIGS. 3 and 4. The notch grooves 20 are formed in parallel with a coating surface to be pressed onto the recording surface of a recording medium so that the coating surface is made flat under a condition of being held by holding pawls 26 which are specifically described later.

Figure 6:
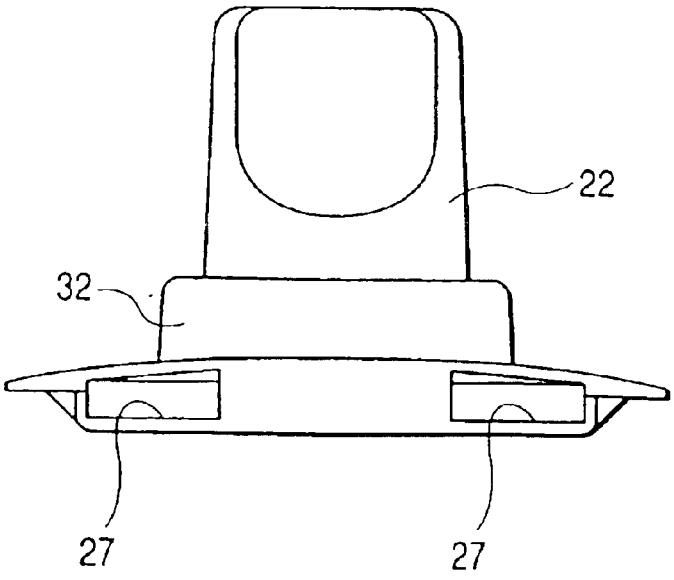
FIG. 6 is a schematic lateral view of the holding member of the coating tool of FIG. 3.
Figure 7:
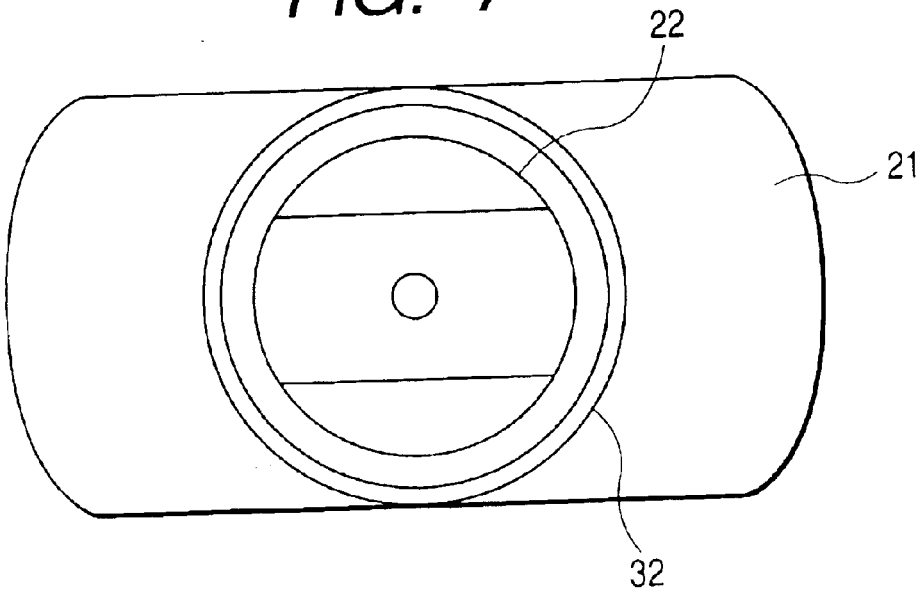
FIG. 7 is a schematic plan view of the holding member of FIG. 6.
Figure 8:
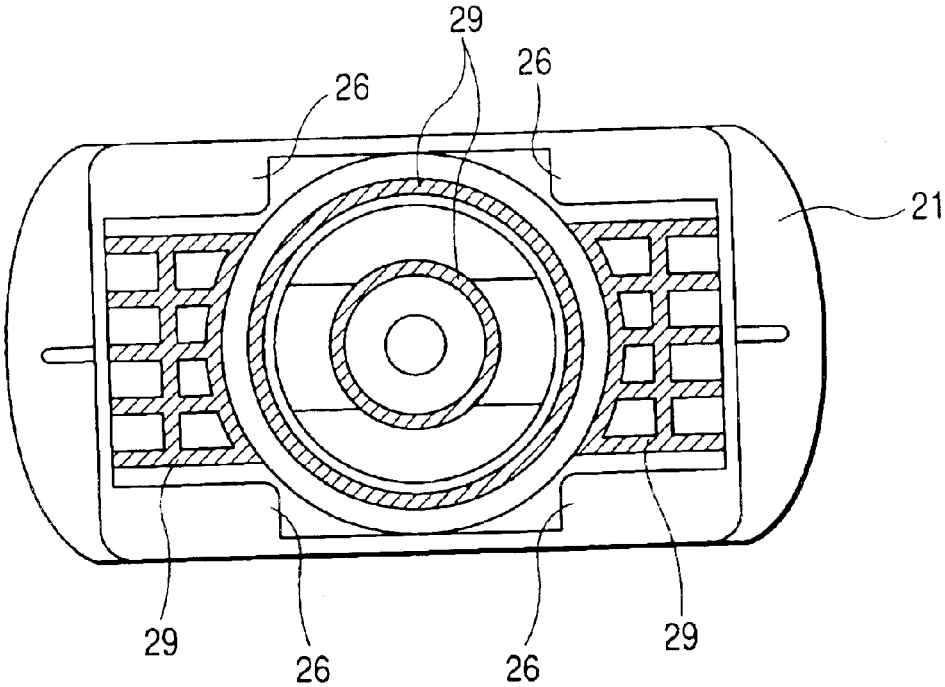
FIG. 8 is a bottom view of the holding member of FIG. 6.

The holding member 8 of the coating tool 3 is typically made of a resin material and comprises a holding section 21 adapted to hold the protection liquid absorbing member 7 and a grip section 22 adapted to be gripped by the operator who uses the coating tool 3 as shown in FIGS. 6, 7 and 8.

Figure 5:
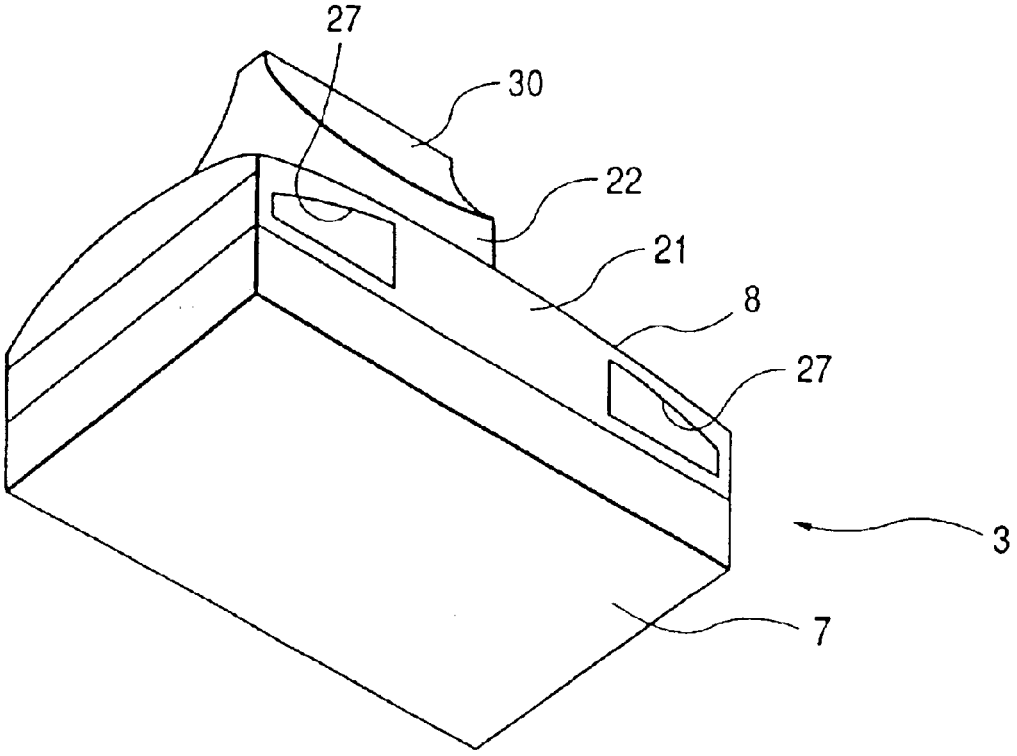
FIG. 5 is a schematic perspective view of the coating tool of FIG. 3, as viewed from the application surface side of the protection liquid absorbing member.

The holding section 21 has a substantially rectangularly parallelepipedic profile and is provided at the bottom thereof with a recess 24 having a depth sufficient for hiding the upper half of the protection liquid absorbing member 7 as shown in FIGS. 3, 4 and 5. The recess 24 of the holding section 21 is provided with holding pawls 26 as integral parts thereof at the corners thereof that corresponds to the corners of the protection liquid absorbing member 7. The holding pawls 26 are adapted to be engaged with the notch grooves 20 of the protection liquid absorbing member 7 to hold the latter.

As shown in FIGS. 3, 4 and 6, the holding section 21 is provided with a plurality of ventilation ports 27 for leading air to the protection liquid absorbing member 7 at positions of the holding section corresponding to the lateral surfaces of the protection liquid absorbing member 7. With the provision of such ventilation ports 27, the operation of causing the protection liquid absorbing member to absorb and discharge protection liquid can be performed well. While the holding section 21 is provided with a plurality of ventilation ports 27 at positions of the holding section corresponding to the lateral surfaces of the protection liquid absorbing member 7 in the above description, a plurality of ventilation ports may alternatively be formed at the top plate section that corresponds to the rear surface of the protection liquid absorbing member 7.

As shown in FIGS. 4 and 8, the recess 24 of the holding section 21 is provided integrally with a plurality of support ribs 29 adapted to abut and support the rear surface of the protection liquid absorbing member 7. With this arrangement, the rear surface of the protection liquid absorbing member 7 is supported by the support ribs 29 when the protection liquid absorbing member 7 is pressed onto the recording surface of a recording medium so that the application surface of the protection liquid absorbing member 7 is made very flat and hence protection liquid can be applied smoothly and effectively. The support ribs 29 may be a support plate having a main surface adapted to abut the entire rear surface of the protection liquid absorbing member 7.

As shown in FIGS. 6 and 7, the grip section 22 has a substantially cylindrical profile and is integrally formed with the holding section 21 at a central part of the latter. The grip section 22 is provided on the outer periphery thereof with concave grip surfaces 30 that allow the grip section 22 to be held by fingers. Additionally, the holding section 21 of the holding member 8 is provided with a round engaging projection 32 formed integrally along the outer periphery thereof and adapted to be engaged with the closure member 5.

The container 4 of the coating set 1 has a substantially cylindrical profile and is provided with an open end and a closed bottom. It is typically made of a resin material. As shown in FIG. 2, the container 4 comprises a containing section 33 for containing protection liquid located on the bottom surface. The containing section 33 has a diameter greater than the length of the application surface of the protection liquid absorbing member 7 of the coating tool 3 so that the protection liquid absorbing member 7 may be dipped into the protection liquid contained there. The container 4 is provided on an outer peripheral part thereof located immediately below the opening with a threaded section 34 that is adapted to be engaged with the corresponding threaded section of the closure member 5.

The closure member 5 of the coating set 1 also has a substantially cylindrical profile and is provided with an open bottom and a closed top. However, the closed top closing the open end of the container 4 has an insertion hole 36 at the center of the principal surface thereof that allows the grip section 22 of the coating tool 3 to pass through. Although not shown, the closure member 5 is provided on the inner principal surface thereof and along the edge defining the insertion hole 36 with an integral annular engaging projection that is adapted to be engaged with the round engaging projection 32 of the holding section 21 of the holding member 8. The closure member 5 is provided on the inner peripheral surface thereof with a threaded section (not shown) that is adapted to be engaged with the threaded section 34 of the container 4.

With the coating set 1 having the above described configuration, protection liquid is absorbed by the protection liquid absorbing member 7 as the protection liquid absorbing member 7 held by the coating tool 3 is dipped into the protection liquid contained in the container 4 and pushed down so as to become compressed. Then, protection liquid is applied to the recording surface of the recording medium as the application surface of the protection liquid absorbing member 7 of the coating tool 3 is moved to slide on the recording surface of the recording medium.

With the coating set 1, as the holding section 21 of the holding member 8 is housed in the container 4 with the grip section 22 of the holding member 8 projecting through the insertion hole 36 of the closure member 5 and the closure member 5 is engaged with the container 4 to close the open end of the container 4, the coating tool 3 is snugly stored in the container 4 and the container 4 is airtightly closed.

As described above, the coating tool 3 of the coating set 1 comprises a protection liquid absorbing member 7 having a density between 30 kg/M$^3$ and 200 kg/m$^3$ and a holding member 8 holding the protection liquid absorbing member 7 so that protection liquid can be applied uniformly and sufficiently onto the recording medium without being influenced by possible variances in the protection liquid application technique that are attributable to the operator. The recording medium coated with protection liquid by means of the coating set 1 performed excellently in an accelerated degradation test to prove that it is highly durable and reliably maintains the initial quality of the recorded image.

Additionally, as the coating tool 3 of the coating set 1 is provided with holding pawls 26 for holding the protection liquid absorbing member 7, it is no longer necessary to bond the protection liquid absorbing member 7 to the holding member 8 by means of adhesive so that the risk that some of the ingredients of the adhesive is eluted into the protection liquid in the container 4 and also the risk that the adhesive agent is degraded by protection liquid until the protection liquid absorbing member 7 comes off are reliably avoided.

When the coating set 1 is shipped with the protection liquid absorbing member 7 impregnated with protection liquid in advance, the coating tool 3 needs to be contained in the container 4. Since the container 4 is adapted to airtightly contain the coating tool 3, the risk that the protection liquid in the container 4 is hydrolyzed and/or leaks out from the container 4 is reliably avoided. Therefore, the coating set 1 can be shipped safely with the protection liquid absorbing member 7 impregnated with protection liquid in advance and the protection liquid absorbing member 7 impregnated with protection liquid is protected against hydrolysis due to environmental causes so that it can enjoy a prolonged service life.

Since the coating tool 3 of the coating set 1 is provided at the holding section 21 thereof with a plurality of ventilation ports 27 so as to smoothly supply air to or remove air from the protection liquid absorbing member 7, the protection liquid absorbing member 7 can sufficiently absorb protection liquid and hence satisfactorily discharge protection liquid during the coating operation. Thus, protection liquid can be applied smoothly, sufficiently and satisfactorily by means of the coating tool 3. Since the ventilation ports 27 serve as relief holes for allowing the sliding cores to slide when forming holding pawls 26 having an undercut profile in the course of manufacturing the holding member 8 by injection molding, they can be produced with ease. As the holding section 21 of the coating tool 3 is provided with ventilation ports 27, the protection liquid absorbing member 7 can absorb protection liquid very quickly if compared with a coating tool not provided with such ventilation ports 27.

While the coating tool 3 of the above described coating set 1 is adapted to apply protection liquid for protecting the images recorded on recording mediums, it may be appreciated that it can also suitably be used to protect other types of information such as character information recorded by an ink-jet recording system.

EXAMPLES

Now, a coating tool 1 according to the invention will be described further by way of examples, although the following description should not be interpreted limitatively.

Figure 9:
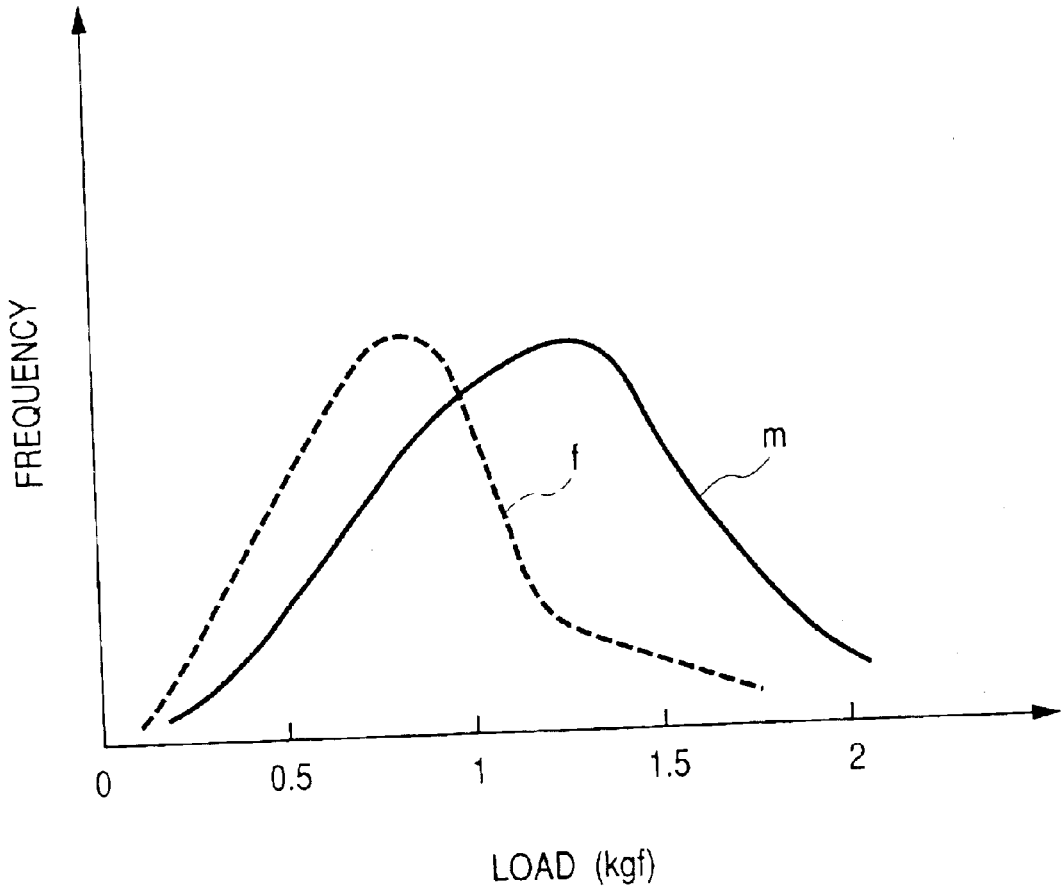
FIG. 9 is a graph illustrating the relationship between the load and the frequency of application of the load as applied to the protection liquid absorbing member of a coating tool, showing that the load can vary depending on the operator of a coating tool according to the invention.

FIG. 9 shows the relationship between the load and the frequency of application of the load when the operator holds the grip section 22 of the holding member 8 of a coating tool 3 according to the invention and applies protection liquid by way of the protection liquid absorbing member 7, as obtained by statistically analyzing the load applied to the protection liquid absorbing member 7. In FIG. 9, the vertical axis represents the frequency of load application and the horizontal axis represents the applied load. In terms of operation of applying protection liquid by an operator, a load not more than 0.5 kgf corresponds to "light application" of protection liquid and a load between 0.5 kgf and 1 kgf corresponds to "medium application" of protection liquid, whereas a load between 1 kgf and 1.5 kgf corresponds to "strong application" of protection liquid and a load between 1.5 kgf and 2.0 kgf corresponds to "very strong application" of protection liquid.

As seen from FIG. 9, the load applied to the protection liquid absorbing member 7 varies depending on the operator. The average load is mostly between 0.5 kgf and 1 kgf in the case of a female operator as indicated by broken line f, whereas the average load is mostly between 0.5 kgf and 1.5 kgf in the case of a male operator as indicated by solid line m. Taking the difference into consideration, specific configurations of coating tool according to the invention that are adapted to apply protection liquid at a constant rate regardless of variances in the load applied to the protection liquid absorbing member by the operator will be discussed below.

Example 1

An image whose tone was comparable to that of photographs was recorded on a recording medium having an ink receiving layer of pseudo-boemite by means of an ink-jet printer (BJF879: tradename, available from Canon Inc.). The recording medium had a multilayer structure of a base paper (base member), a reflection layer ($BaSO_4$ layer having a thickness of about 15 $\mu$m) and an about 30 $\mu$m thick ink receiving layer made of pseudo-boemite type alumina laid sequentially one on the other. The image was recorded on the recording medium by using ink-jet printer ink to find that the coloring materials of the applied ink were adsorbed to the ink receiving layer containing alumina to produce the recorded images. After the image recording operation, it was found that the ink receiving layer was still containing voids.

As protection liquid, transparent and odorless saturated aliphatic acid ester obtained by removing unsaturated ingredients of grease that can produce a yellowy color and odor (trimethylolpropane triisostealate expressed by the structural formula shown below (viscosity: 200 Cst)) was used. The protection liquid was applied to the entire recording surface of the recording medium carrying the recorded image by an amount greater than the amount necessary for filling the voids in the ink receiving layer and left in the ambient air after the application for an appropriate period of time. Then, the excessive protection liquid remaining on the surface of the ink receiving layer was quickly wiped out.

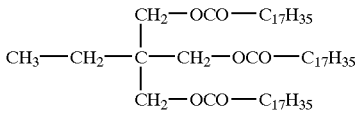

Figure 10:
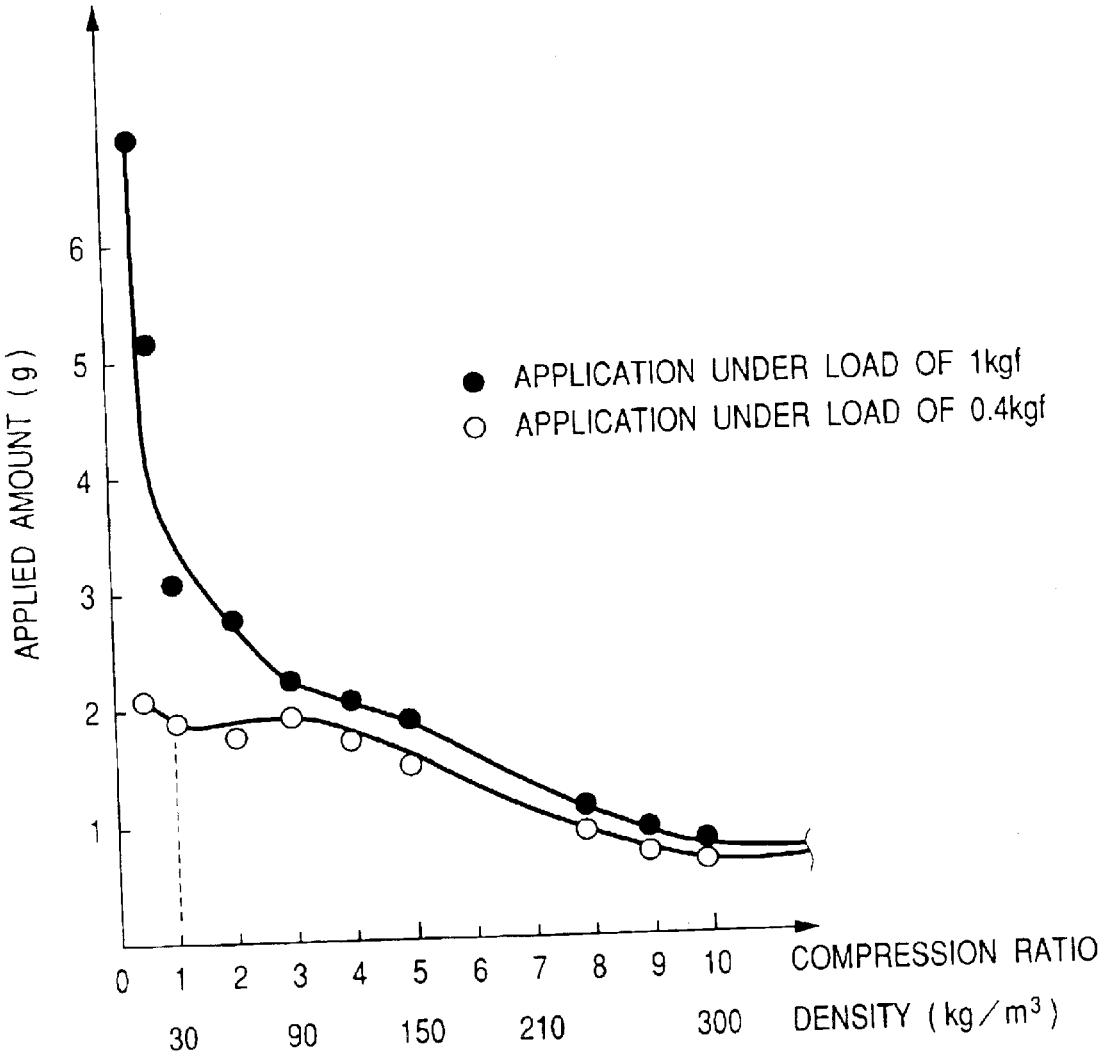
FIG. 10 is a graph illustrating the relationship between the density of the protection liquid absorbing member and the amount of applied protection liquid.

For applying protection liquid, a piece of urethane sponge having dimensions of 35 mm×55 mm×10 mm was used as protection liquid absorbing member and the density of the urethane sponge was made to vary by changing the compression ratio. The amount of protection liquid actually applied onto the recording medium (A4 size) was determined as the difference between the weight of the recording medium after the application of protection liquid and before the removal of the excessive protection liquid and the weight of the recording medium after the removal of the excessive protection liquid. FIG. 10 is graph illustrating the relationship of the amount of applied protection liquid and the compression ratio and the density of the protection liquid absorbing member for different loads.

As shown in FIG. 10, the amount of applied protection liquid is raised by pressing the protection liquid absorbing member relatively strongly, when the density of the protection liquid absorbing member is relatively low and found between 10 kg/m$^3$ and 20 kg/m$^3$ (the member is relative soft), while the applied amount is reduced by pressing the protection liquid absorbing member relatively lightly. In other words, the rate of application varies as a function of the load applied to the protection liquid absorbing member in the protection liquid applying operation.

On the other hand, when the density of the protection liquid absorbing member is relatively high and found between 30 kg/m$^3$ and 200 kg/m$^3$ (the member is relatively hard), the load dependency of the amount of applied protection liquid becomes low and protection liquid can be applied at a relatively constant rate because it is difficult to push and compress the protection liquid absorbing member.

When the density of the protection liquid absorbing member is made greater than 200 kg/M$^3$, protection liquid is supplied only scarcely from the inside of the protection liquid absorbing member to reduce the rate of application and produce an undesirable situation.

In an experiment, different operators applied protection liquid, using a protection liquid absorbing member whose density was between 30 and 200 kg/m$^3$. All the operators applied protection liquid satisfactorily producing neither a poorly applied situation nor an excessively applied situation. When the images protected by protection liquid were subjected to an accelerated degradation test (where they were exposed to 3 ppm ozone for 2 hours), they proved to be practically free from degradation.

Reference Example

Figure 11:
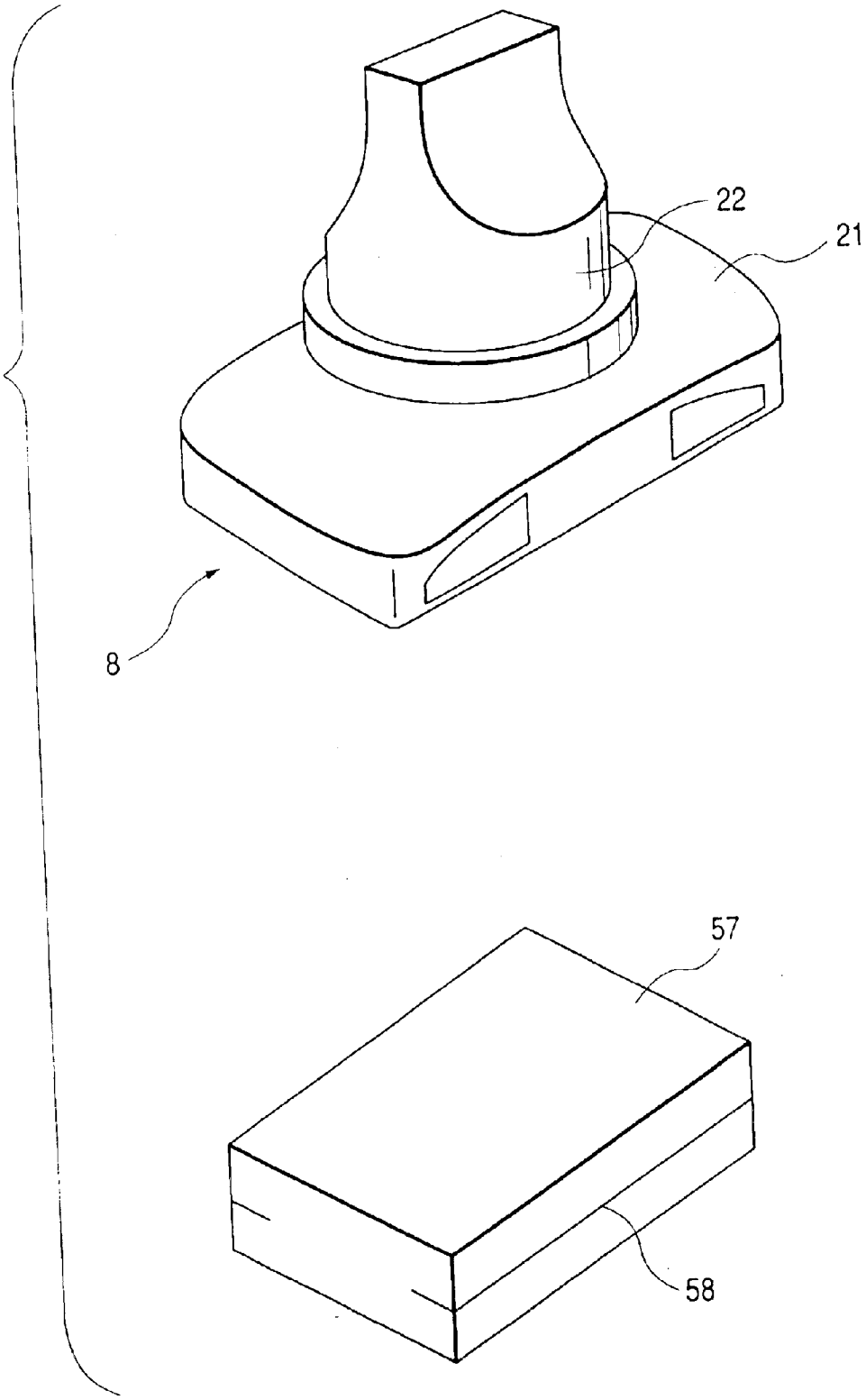
FIG. 11 is an exploded schematic perspective view of another protection liquid absorbing member that is provided with cut out areas shown for the purpose of comparison.
Figure 12:
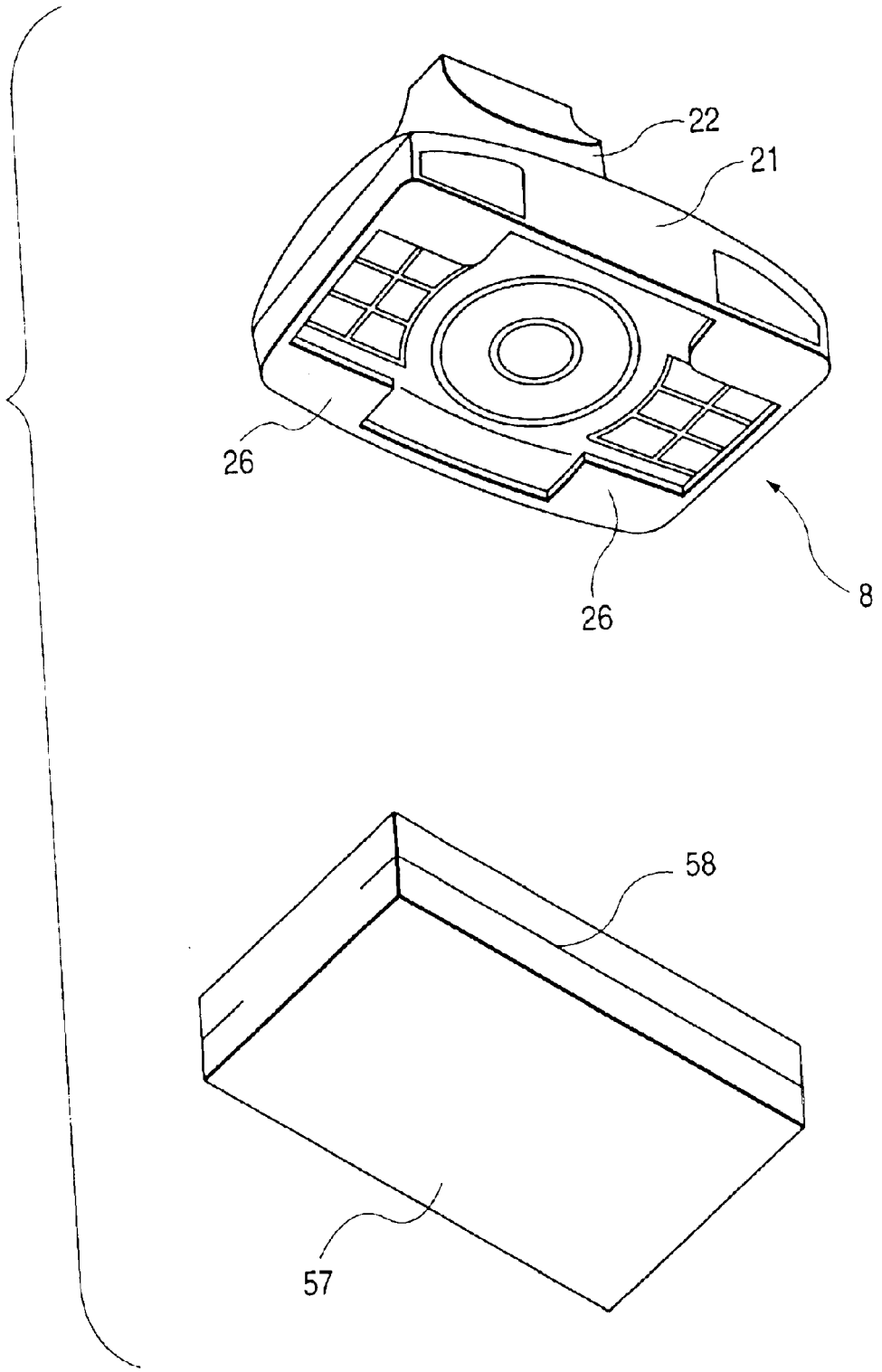
FIG. 12 is an exploded perspective view of the protection liquid absorbing member of FIG. 11 as viewed from the application surface side.

While the protection liquid absorbing member 7 of the above described embodiment of coating tool according to the invention is provided with notch grooves 20 with which the holding pawls 26 of the holding member 8 are engaged, the protection liquid absorbing member 57 shown in FIGS. 11 and 12 for comparison are provided on lateral surfaces thereof with slots 58 with which the holding pawls 26 are engaged so that the holding pawls 26 may be able to hold the protection liquid absorbing member 57. This arrangement has a drawback as will be described below.

Figure 13:
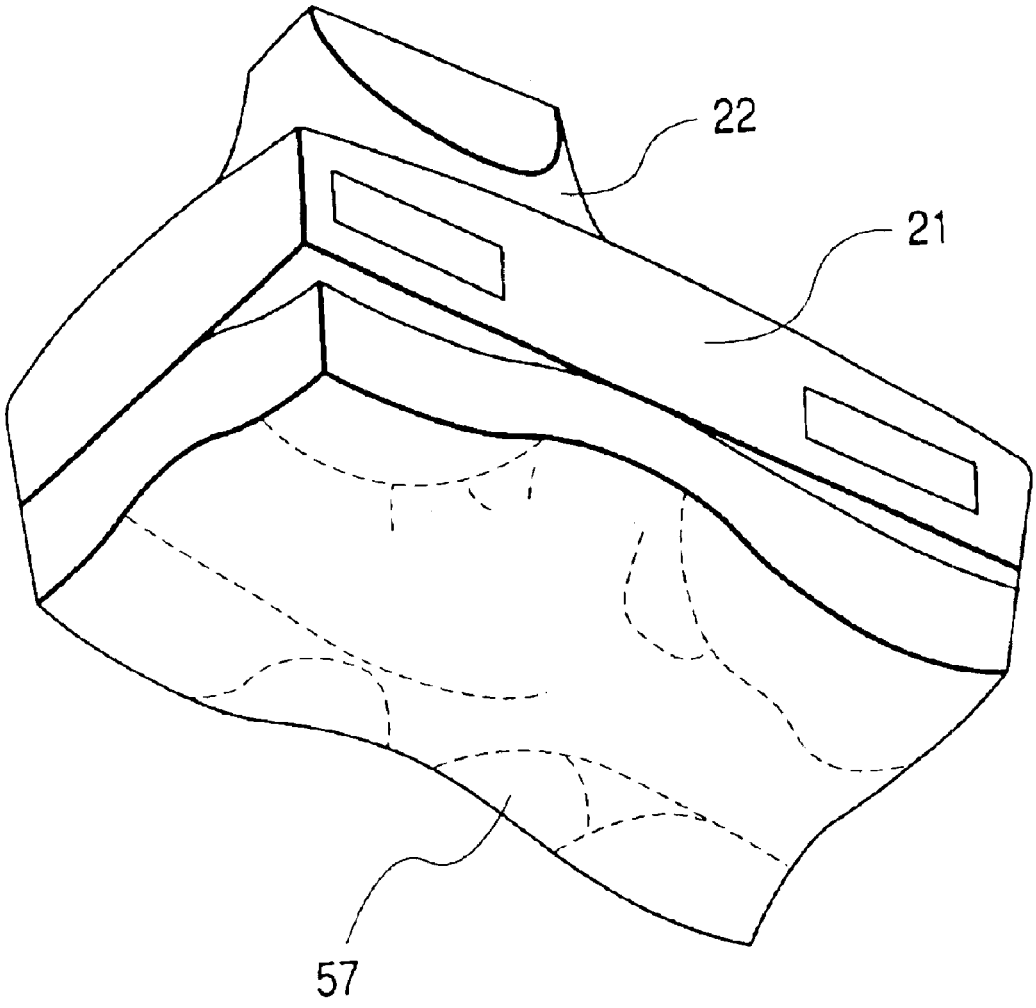
FIG. 13 is a schematic perspective view of the protection liquid absorbing member of FIG. 11, showing a warp formed on the application surface.

Referring to FIG. 13, as the slots 58 of the protection liquid absorbing member 57 are engaged with the holding pawls 26, the coating surface of the protection liquid absorbing member 57 becomes disadvantageously swollen by the volume of the holding pawls 26. Then, the protection liquid absorbing member 57 that is provided with slots 58 can slide on the recording medium only at the opposite ends thereof. Then, while protection liquid is applied by the opposite ends of coating surface of the protection liquid absorbing member 57, the central part of the coating surface cannot sufficiently apply protection liquid. In other words, there are areas on the surface of the recording medium where protection liquid is applied only scratchily by the central part of coating surface of the protection liquid absorbing member 57.

Thus, the protection liquid absorbing member 7 of a coating tool 3 according to the invention is provided not with slots 58 but notch grooves 20 along opposite lateral sides thereof. The notch grooves 20 can maintain the coating surface of the protection liquid absorbing member 7 very flat so that protection liquid can be applied uniformly.

Example 2

In this example, polyester type urethane sponge was used for the protection liquid absorbing member and compared with a protection liquid absorbing member made of polyether type urethane sponge. A protection liquid absorbing member made of polyether type urethane sponge did not completely absorb the protection liquid in the container if it is dipped into the protection liquid. On the other hand, a protection liquid absorbing member made of polyester type urethane sponge showed strong affinity for protection liquid and the protection liquid in the container was sufficiently absorbed by it within about 1 minute to make the protection liquid absorbing member ready for the coating operation. In other words, the protection liquid absorbing member made of polyester urethane sponge performed satisfactorily for holding and applying protection liquid.

Example 3

In this example, polyether type urethane sponge was used for the protection liquid absorbing member. While the protection liquid absorbing member made of polyether type urethane sponge did not absorb completely the protection liquid in the container when it was dipped into the liquid, it came to absorb the protection liquid when it was forced to mechanically absorb protection liquid in order to utilize the hydrolysis-resistance of polyether type polyurethane sponge.

More specifically, the protection liquid absorbing member made of polyether type urethane sponge was dipped into the protection liquid in the container and then it was mechanically compressed to expel the air contained in the sponge of the protection liquid absorbing member. The compressing operation was terminated when the air was expelled from the sponge. Then, it was found that the protection liquid was absorbed by the sponge due to the restoring force of the protection liquid absorbing member. Once the protection liquid was absorbed, the protection liquid absorbing member maintained its affinity for protection liquid. In other words, after discharging almost all the protection liquid that the protection liquid absorbing member had absorbed, the latter showed strong affinity for protection liquid in the next coating cycle and satisfactorily absorbed the protection liquid poured into the container within 1 minute so that it was ready for the next coating operation. Thus, the protection liquid absorbing member made of polyether type urethane sponge performed satisfactorily for holding and applying protection liquid.

Example 4

When the inside of the grip section 22 of the coating tool 3 is hollowed, the rear surface of the protection liquid absorbing member 7 finds no surface supporting it at the center thereof. In an experiment using such a coating tool 3, the central part of the coating surface of the protection liquid absorbing member showed a reduced rate of application and protection liquid was applied only scratchily in extreme cases.

When a 1 mm thick plate of polypropylene showing sufficient rigidity was arranged on the rear surface of the protection liquid absorbing member 7, the central part of the coating surface of the protection liquid absorbing member 7 was satisfactorily held in contact with and smoothly driven to move on the surface of the recording medium so that the situation where protection liquid was applied only scratchily by the central part of the coating surface was eliminated.

In an attempt to reduce the cost of manufacturing a coating set 1 comprising a coating tool 3 according to the invention, the above plate was replaced by support ribs 29 and various intervals of arrangement of support ribs 29 relative to the coating surface (the density of support ribs 29 relative to the coating surface) of the protection liquid absorbing member 7 were tested to realize a satisfactory coating effect. The obtained results are summarized in Table 1 below.

TABLE 1

| Intervals of support ribs (density) | Scratchy application of protection liquid |
|---|---|
| Plate (on the entire rear surface of protection liquid absorbing member) | None |
| 5 mm | None |
| 10 mm | None |
| 15 mm | Observed |
| 20 mm | Observed |

As shown in Table 1, scratchy application of protection liquid occurs when a plurality of support ribs 29 are arranged at intervals of 15 mm or more, whereas no such situation occurs when ribs 29 are arranged at intervals of 10 mm or less.

A coating tool 3 satisfying the above requirement was used to apply protection liquid and a satisfactory coating effect was obtained. After the application, the excessive protection liquid was removed from the recording medium. Thus, the coating tool 3 performed satisfactorily for holding and applying protection liquid.

Example 5

Figure 14A:
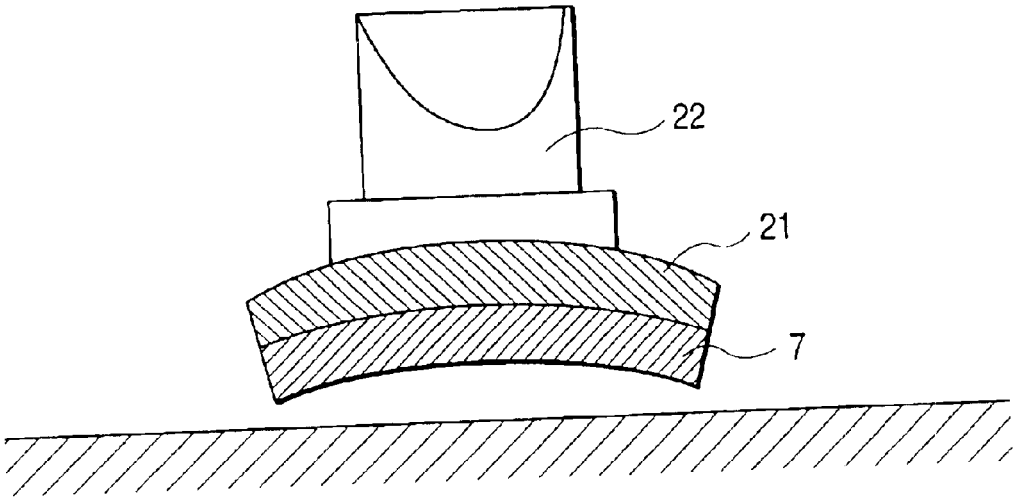
FIG. 14A is a schematic lateral view of the protection liquid absorbing member of a coating tool according to the invention, showing the initial deflection formed on the application surface thereof
Figure 14A:
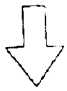
Figure 14B:
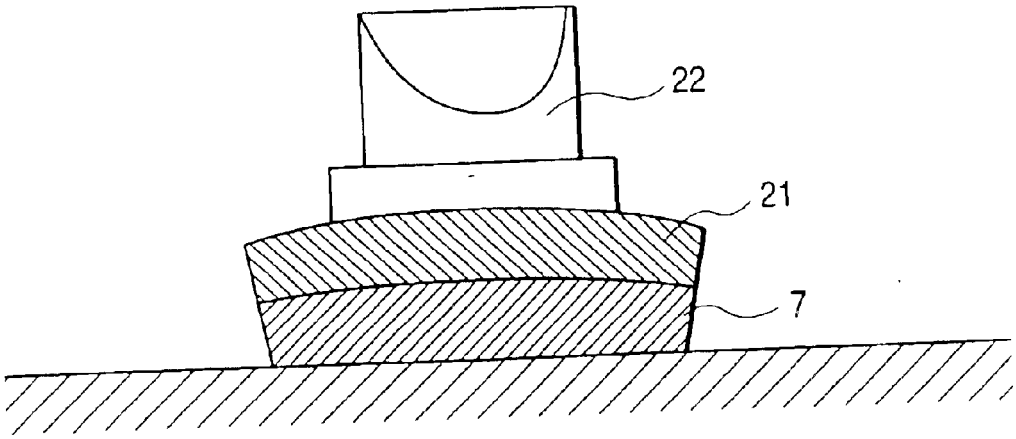
FIG. 14B is a schematic lateral view of the protection liquid absorbing member showing the application surface pressed against a recording medium.

FIGS. 14A and 14B schematically illustrate the protection liquid absorbing member of the coating tool used in this example. FIG. 14A shows the initial deflection formed on the application surface thereof and FIG. 14B shows the application surface pressed against a recording medium under a load. When the holding member 8 does not have sufficient rigidity, the central part of the protection liquid absorbing member 7 is deflected so as to form concave a recess in the central area of the coating surface of the protection liquid absorbing member 7 so that the coating surface projects at the longitudinal opposite ends. Then, the pressure applied to the coating tool is transmitted to the central part of the protection liquid absorbing member 7 that corresponds to the grip section 22 of the holding member 8 so that the coating surface of the protection liquid absorbing member 7 becomes flat as shown in FIG. 14B and hence protection liquid can be applied uniformly.

While the optimal deflection of the protection liquid absorbing member 7 (the position of the center of the coating surface relative to the longitudinal opposite ends) varies depending on the rigidity of the container 4 and the load applied to the coating tool 3, the protection liquid absorbing member 7 can absorb certain degree of variance. In an experiment, it was found that a coating tool 3 having a protection liquid absorbing member 7 showing a deflection of as small as 1 mm could uniformly apply protection liquid if compared with a coating tool having a protection liquid absorbing member showing no deflection.

Example 6

Table 2 summarizes the results obtained in an experiment on the depth of the notch grooves 20 formed on the lateral sides of the protection liquid absorbing member 7 as observed in a direction perpendicular to the lateral surfaces of the protection liquid absorbing member 7 (to be simply referred to as the depth of the notch grooves hereinafter).

A number of protection liquid absorbing members 7 having dimensions of 35 mm (length)×55 mm (width)×10 mm (height) were prepared and a 1 mm wide notch groove 20 was formed on each of the 55 mm long lateral sides of the protection liquid absorbing members. The depth of the notch grooves 20 of the specimens of protection liquid absorbing member was made to vary from specimen to specimen. Depths of 2 mm, 3.5 mm, 5.8 mm and 10 mm were used and coating tools were prepared by using such protection liquid absorbing members.

TABLE 2

| Depth of notch groove (mm) | Holding strength | Warp |
|---|---|---|
| 2 | Fair | None |
| 3.5 | Good | None |
| 5 | Good | None |
| 8 | Good | Observed |
| 10 | Good | Observed |

As shown in Table 2, the holding section 21 could not reliably hold the protection liquid absorbing member 7 when the notch grooves 20 were shallow. On the other hand, the lateral edges of the protection liquid absorbing member 7 were deformed to produce warps and wrinkles when the notch grooves 20 were deep. In other words, the depth of the notch grooves 20 can be optimally selected on the basis of the holding strength and appearance of warps and wrinkles.

More specifically, if each of the notch grooves 20 of the protection liquid absorbing member 7 is located at position h (mm) as determined in a direction perpendicular to the coating surface and has a depth of d (mm), warps and wrinkles can be reliably prevented from appearing by forming the notch groves 20 so as to satisfy the requirement of $$d<2h.$$

Example 7

When protecting a recorded image by means of protection liquid, the following requirements are preferably met.

(1) Recording mediums to which protection liquid is applied may have a number of different sizes including:

photograph size, which is also referred to as the L size (89 mm×119 mm), post card size (100 mm×148 mm), 2L size (twice as large as the L size) (119 mm×178 mm), A4 size (210 mm×297 mm), and A3 size (420 mm×297 mm).

Table 3 summarizes the results of application of protection liquid obtained in an experiment where protection liquid was applied to recording mediums of the above sizes by means of a coating tool having a protection liquid absorbing member having dimensions of 35 mm×55 mm×10 mm and made of urethane sponge (the protection liquid absorbing member being provided with notch grooves and adapted to absorb protection liquid by 17 cc and retain it in the inside).

TABLE 3

| Size of recording medium | Dipped once and applied | Dipped twice and applied |
|---|---|---|
| L size | OK (no scratchy application) | OK (no scratchy application) |
| Post card size | OK (no scratchy application) | OK (no scratchy application) |
| 2L size | OK (no scratchy application) | OK (no scratchy application) |
| A4 size | OK (no scratchy application) | OK (no scratchy application) |
| A3 size | NG (scratchy application observed) | OK (no scratchy application) |

As shown in Table 3, protection liquid could be applied satisfactorily to recording mediums of the L size, the post card size, the 2L size and the A4 size by dipping the protection liquid absorbing member in protection liquid only once and to a recording medium of the A3 size by dipping the protection liquid absorbing member twice in protection liquid without producing insufficiently applied areas. The recording mediums to which protection liquid was applied were highly satisfactory both initially and after a long storage period.

Meritorious Effects

As described above, protection liquid is applied uniformly on the recording surface of a recording medium regardless of variance in the coating operation of the operator using a coating tool when it is applied by means of the coating tool according to the invention having the holding member holding the protection liquid absorbing member that is formed to show a density not less than 30 kg/m$^3$.

According to the invention, the holding section of the holding member has holding pawls for holding the protection liquid absorbing member. With the provision of holding pawls, it is no longer necessary to bond the protection liquid absorbing member to the holding member by means of adhesive. Then, the risk that some of the ingredients of the adhesive leak out into protection liquid and the adhesive is degraded by protection liquid is prevented from occurring.

According to the invention, the protection liquid absorbing member is supported as the entire rear surface of the protection liquid absorbing member disposed opposite to the coating surface thereof is made to abut the holding section of the holding member. The holding section of the holding member is provided with a plurality of support ribs adapted to abut and support the rear surface of the protection liquid absorbing member. With this arrangement, the entire coating surface of the protection liquid absorbing member is made to slide smoothly on the recording medium when applying protection liquid onto the recording medium.

According to the invention, the coating surface of the protection liquid absorbing member is deflected to a predetermined extent with a curved recess formed in a substantially central part thereof so as to make the coating surface become a flat surface in a condition where a predetermined load is applied to it for the operation of applying protection liquid. With this arrangement, the entire coating surface of the protection liquid absorbing member is made to slide smoothly on the recording medium when applying protection liquid onto the recording medium.

According to the invention, the holding member is provided with a plurality of ventilation ports for leading air to the protection liquid absorbing member at positions of the holding section corresponding to the lateral surfaces or the rear surface of the protection liquid absorbing member. With the provision of such ventilation ports, the operation of causing the protection liquid absorbing member to absorb and discharge protection liquid can be performed well.

The present invention provides at low cost a coating tool and a coating set that can improve the storability of recording mediums in the atmosphere to a level better than that of silver salt photographs so that the viewers of the recorded image may be able to directly see the image recorded on the recording medium without an optical coat film layer formed on the recording surface of the recording medium.

What is claimed is:

1. A coating tool for applying protection liquid onto the surface of a recorded matter recorded on a recording medium by injecting ink by means of an ink-jet recording system, said tool comprising:

a protection liquid absorbing member for absorbing and holding protection liquid, said protection liquid absorbing member having a coating surface to be pressed against the recording surface;

a holding member having a holding section holding the protection liquid absorbing member; and a grip section to be gripped for holding the holding section, wherein the protection liquid absorbing member has a density of at least 30 kg/m$^3$.

2. The tool according to claim 1, wherein said protection liquid absorbing member has a density of between 30 kg/m$^3$ and 200 kg/m$^3$.

3. The tool according to claim 1, further comprising:

protection liquid made of organic non-volatile oil which is absorbed and held by said protection liquid absorbing member.

4. The tool according to claim 3, wherein said protection liquid absorbing member is made of polyester type polyurethane foam.

5. The tool according to claim 3, wherein said protection liquid absorbing member is made of polyether type polyurethane foam.

6. The tool according to claim 1, wherein said holding section of said holding member is provided with holding pawls holding said protection liquid absorbing member.

7. The tool according to claim 6, wherein said protection liquid absorbing member has lateral surfaces provided with notch grooves running in parallel with said coating surface so that the coating surface is made flat under a condition of being held by said holding pawls.

8. The tool according to claim 7, wherein said protection liquid absorbing member is provided with said notch grooves so as to satisfy the requirement of $$d<2h,$$

where d is the depth of each of said notch grooves in a direction perpendicular to the lateral surfaces of the protection liquid absorbing member and h is the position of each of said notch grooves as determined from the coating surface of the protection liquid absorbing member.

9. The tool according to claim 1, wherein said protection liquid absorbing member has a rear surface located opposite to the coating surface which is made to abut and supported by said holding section of said holding member.

10. The tool according to claim 9, wherein said holding section of said holding member is provided with a support plate having a main surface adapted to abut the entire rear surface of said protection liquid absorbing member.

11. The tool according to claim 9, wherein said holding section of said holding member is provided with a plurality of support ribs adapted to abut the rear surface of said protection liquid absorbing member.

12. The tool according to claim 11, wherein said plurality of support ribs are arranged at intervals not more than 10 mm.

13. The tool according to claim 1, wherein the coating surface of said protection liquid absorbing member has a concaved shape by such a degree of deflection that the coating surface is turned flat when a load is applied thereto in order to apply protection liquid.

14. The tool according to claim 1, wherein said holding section of said holding member is provided at positions corresponding to lateral surfaces of said protection liquid absorbing member or to a rear surface of said protection liquid absorbing member located opposite to the coating surface thereof with ventilation ports for leading air to the protection liquid absorbing member.

15. A coating set comprising a coating tool according to any one of claims 1 through 14 and a container having a storage section storing the protection liquid.

* * * * *